US005109583A

United States Patent [19]

Pavlov

[11] Patent Number: 5,109,583

[45] Date of Patent: May 5, 1992

[54] METHOD OF MANUFACTURING BARBED TAPE

[76] Inventor: Michael V. Pavlov, R.D. #4, Box A27A, Kingston, N.Y. 12401

[21] Appl. No.: 434,007

[22] Filed: Nov. 9, 1989

Related U.S. Application Data

[63] Continuation of Ser. No. 814,782, Dec. 30, 1985, abandoned.

[51] Int. Cl.[5] ..... B21F 25/00

[52] U.S. Cl. ..... 29/7.1; 72/176; 72/190

[58] Field of Search ..... 72/184, 190, 176; 256/8, 2; 428/592, 595, 599, 573, 603; 29/7.1, 7.2, 7.3; 140/58, 66

[56] References Cited

U.S. PATENT DOCUMENTS

| | | | |
|---|---|---|---|
| Re. 30,814 | 12/1981 | Mainiero | 72/308 |
| 191,913 | 6/1877 | Barnes | 256/8 |
| 264,726 | 7/1881 | Allis | 256/8 |
| 293,411 | 2/1884 | Brock | 428/573 |
| 386,742 | 7/1888 | Grellner | 256/8 |
| 1,175,433 | 3/1916 | Goetsch | 428/603 |
| 3,376,120 | 4/1968 | Hiegel | 438/603 |
| 3,480,256 | 11/1969 | Simon et al. | 428/573 |
| 3,763,529 | 10/1973 | Musgrave | 256/8 |
| 3,911,705 | 10/1975 | Voorhes | 72/184 |
| 4,028,425 | 6/1977 | Mainiero | 72/308 |
| 4,045,945 | 9/1977 | Musgrave | 72/56 |
| 4,204,415 | 5/1980 | Braad et al. | 72/176 |
| 4,509,726 | 4/1985 | Boggs et al. | 256/8 |
| 4,784,373 | 11/1988 | Mainiero | 72/136 |
| 4,884,425 | 12/1989 | Mainiero | 72/167 |

FOREIGN PATENT DOCUMENTS

| | | | |
|---|---|---|---|
| 211726 | 7/1984 | German Democratic Rep. | 72/190 |
| 55-10304 | 1/1980 | Japan | 72/184 |
| 689772 | 10/1979 | U.S.S.R. | 72/184 |
| 1258518 | 9/1986 | U.S.S.R. | 72/190 |

*Primary Examiner*—John J. Zimmerman
*Attorney, Agent, or Firm*—Schmeiser, Morelle & Watts

[57] ABSTRACT

A barbed tape with a longitudinally extending strengthening groove is formed by pushing a strip of barbed tape to and through forming rolls which cooperate with the tape and a wire mandrel. The wire mandrel includes a continuous loop of wire rope which is guided to and through the forming rolls with the strip of barbed tape to form the longitudinal strengthening groove in the tape. The wire mandrel remains in cooperation with the tape as the grooved tape and wire mandrel move through a radial bender which bends the tape into a helical coil. The tape is provided in reel form and is fed to a blanking press to have barbs formed thereon prior to being fed to the roll former. A take up device receives the coiled tape as it exits the radial bender.

15 Claims, 6 Drawing Sheets

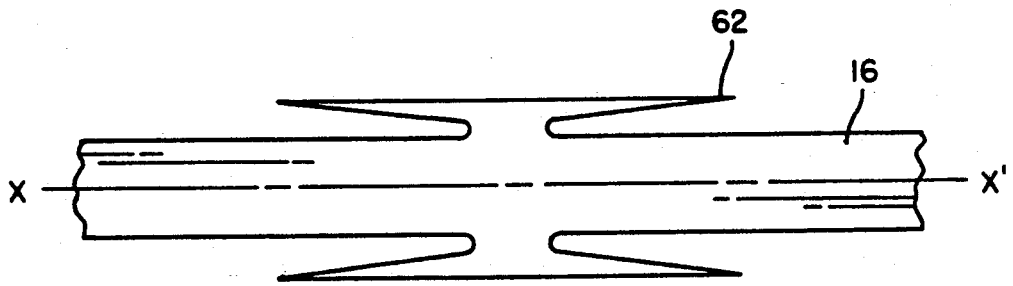
FIG. 2
FIG. 3
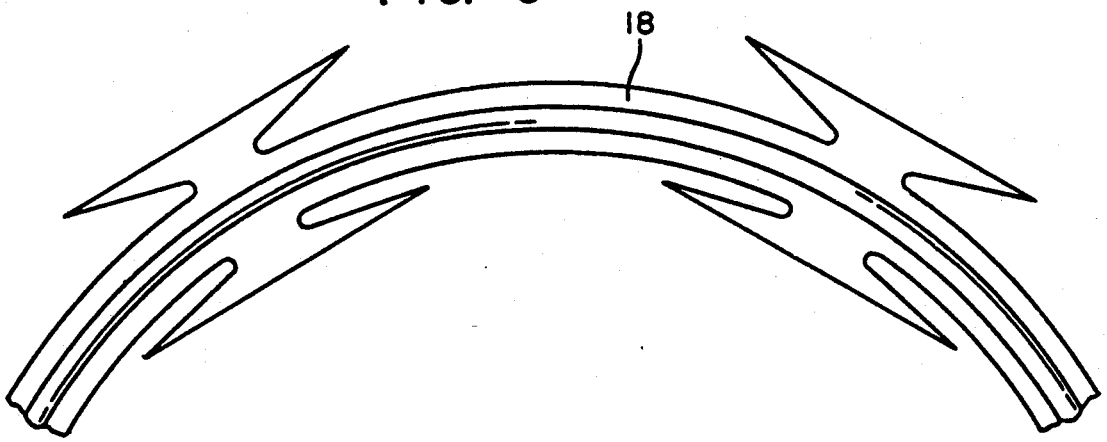

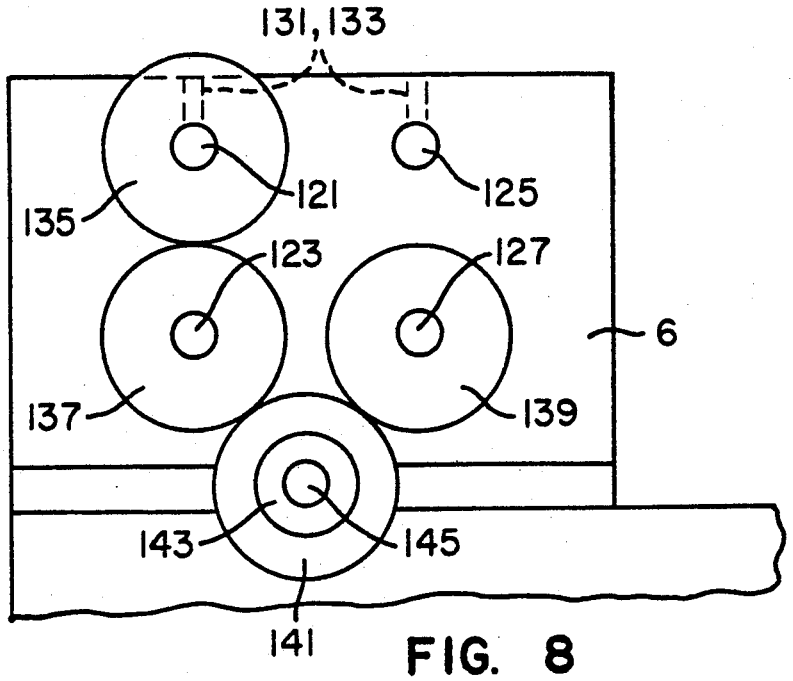
FIG. 8
FIG. 7
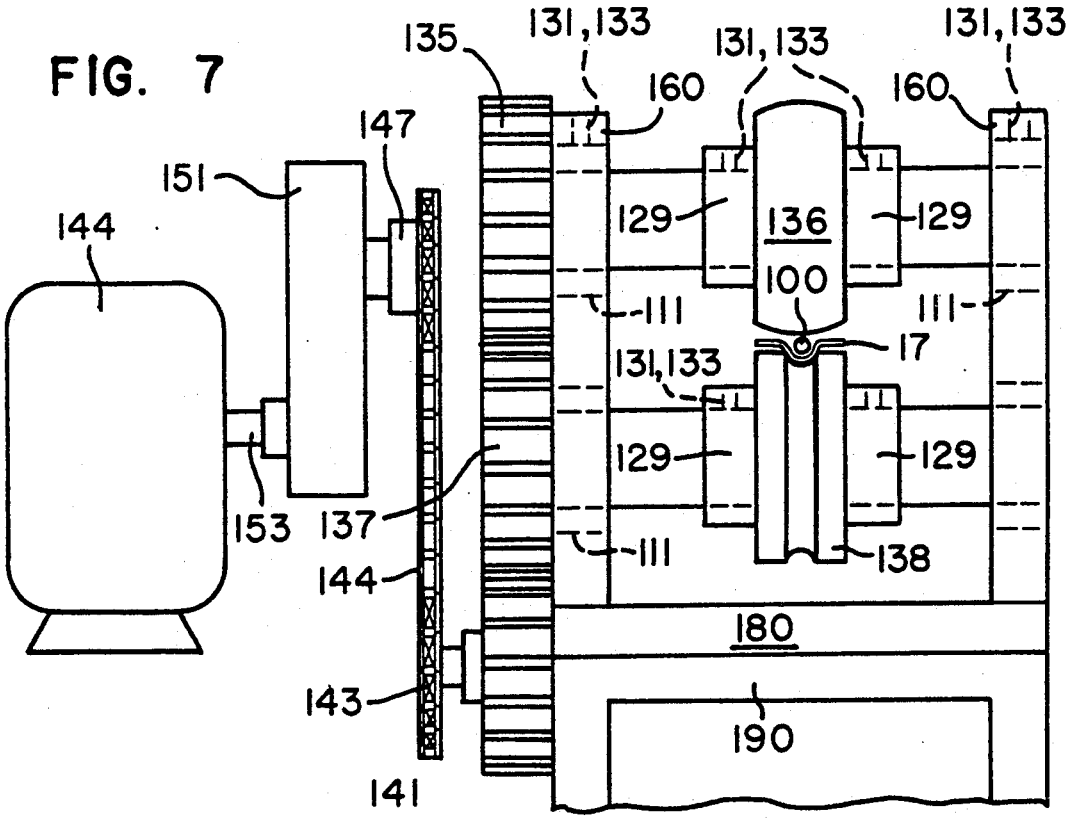

METHOD OF MANUFACTURING BARBED TAPE

This application is a continuation of application Ser. No. 06/814,782, filed Dec. 30, 1985, now abandoned.

BACKGROUND OF THE INVENTION

1. Field of Application

This invention relates to barbed tape; and more particularly to reinforced barbed tape and a method and equipment for its manufacture.

2. Description of the Prior Art

Intrusive barriers are generally used to prevent intrusion into properties. Such properties may have perimeters with fences, walls and like barriers upon and adjacent to which barbed wire and/or barbed strip, and/or barbed tape are placed to enhance the protection of the property. Often the barbed wire or strips are rolled into a concertina-like configuration.

The security obtainable by such barriers can generally be used for retail, wholesale, industrial storage or any commercial business. Armed forces facilitates, prisons, institutions and governmental facilities requiring high security also widely used such barriers as do livestock containment and other like installations requiring secured facilities. Barbed barriers provide a deterrent of entry or egress of unauthorized or undesired personnel.

The use of barbed wire, barbed strip or tape has existed for many years. Wire with barbs has been employed for quite sometime in the construction of fences, walls and barriers deployed on the ground to inhibit the movement of personnel and vehicles in combat as well as for intruder prevention as previously mentioned.

One form of such intrusion prevention barbed device is a strip or ribbon of the type shown in U.S. Pat. No. 3,224,736 granted on Dec. 21, 1965 D. D. Musgrave for Barbed Strip and in U.S. Pat. No. 3,455,539 granted on July 15, 1969 to J. G. Loofbourrow for Barbed Strip. However, barbed strips and ribbons of this type, especially when rolled into a concertina type configuration, have shown a lack of strength or rigidity. In addition, this construction of barrier has also been easy to break through by use of simple hand-held metal cutting tools.

Other forms of barbed strips or tape have utilized grooves or depressions to add strength and rigidity to the barrier material. But constructions of the type shown in U.S. Pat. No. 186,922 granted on Feb. 6, 1877 to J. Brinkerhoff for Metallic Barbed Fence and the U.S. Pat. No. 386,742 granted on Jul. 24, 1888 to C. J. Grellner for Barbed Fence Strip provide such grooves or depressions in a discontinuous manner thus leaving areas of the strip or ribbon which still lack strength or rigidity and which may still be easily severed by hand-held cutters. Barbed strips or tapes such as shown: in U.S. Pat. No. 187,723 granted to A. J. Nellis on Feb. 27, 1877 for Barbed Fence; in U.S. Pat. No. 214,860 granted on Apr. 29, 1879 to F. Woods for Fencing-Strip; and in U.S. Pat. No. 3,463,455 granted on Jul. 1, 1969 to P. T. Meckel for Helical Barbed Tape Unit, on the other hand, incorporate continuous grooves for adding strength and rigidity to the strip or tape. Such barbed tape constructions, however, would still apppear to provide a tape or strip which may not have sufficient strength or rigidity for the intended purpose. The Nellis type construction, for example, reduces the strength of the groove by striking the barbs from the material in the groove; while the Woods type of barbed strip or tape must provide the groove to only one side of the barbs.

A construction as shown by Meckel, on the other hand, provides only a small longitudinal bead or channel which also may not impart an acceptable degree of strength or rigidity to the barrier material. There is, furthermore, no teaching in these patents of how to feasibly and economically obtain the desired groove constructions; especially if the resultant barbed strip is also to be formed into a concertina-type roll or configuration.

Alternatively, available barbed wire or tape constructions provide a reinforcing rib either from the material of the tape itself, or from an additional material attached to the barbed tape material as by welding or other processes. However, the fabrication of such a reinforcing bead from the material of the barbed-tape, requires relatively such as shown in U.S. Pat. No. 3,480,256 granted on Nov. 25, 1969 to G. Simon et al for Barbed Wire, requires relatively complex formation and fabrication equipment and manufacturing processes. On the other hand, the attachment to the barbed tape of a separate reinforcing rib or member may also require relatively complex fabrication equipment and processes. Examples of such barbed wire or barbed tape constructions are shown in: U.S. Pat. No. 3,480,256 granted on Nov. 25, 1969 to Simon et al for Barbed Wire; U.S. Pat. No. 3,763,529 granted on Oct. 9, 1973 D. D. Musgrave for Method of Fabricating Barbed Tape; U.S. Pat. No. 3,916,958 granted on Nov. 4, 1975 to S. Uhi for Process And Apparatus For Producing A Barbed Spiral; and U.S. Pat. No. 4,509,726 granted on Apr. 9, 1985 to W. G. Boggs et al for Barriers. By adding to the relative complexity of the required fabrication equipment and process one adds unduly to the cost of the barbed wire. The added bead of material also adds to the material cost for the barbed tape and adds undesired weight to the resulting barbed tape. This may require more expensive and complex support structure for the barrier which utilizes the bead reinforced barbed tape. Where a separate bead of material is secured to the barbed tape ribbon, especially if a dis-similar material is used, water or moisture may be trapped where the materials come together. This could result in a galvanic action, rusting and weakening of the strength of the barbed tape barrier. Since such barbed barriers are most often disposed outdoors the intrusion of moisture from rain, snow and the formation of ice and dew upon the tape, and the detrimental effects of such moisture intrusion, could and should be expected.

Equipment and processes for drawing metal stock and otherwise fabricating same, such as the equipment and processes shown in: U.S. Pat. No. 2,767,829 granted on Oct. 23, 1956 to K. W. Hallden for Apparatus For Drawing Rod Stock; U.S. Pat. No. 3,373,587 granted on Mar. 19, 1968 to V. N. Shubin et al for Automatic Tube Bending Machines; U.S. Pat. No. 3,668,916 granted on Jun. 13, 1972 to H. C. Ledebur for Drawing Of Metal Tube; and U.S. Pat. No. RE 28,373 granted on Mar. 25, 1975 to F. J. Fuchs Jr. for Apparatus And Method For Continuous Material Feeding And Deformation; are, in fact, relatively complex in construction and operation and costly to purchase, maintain, and operate. Such equipment by drawing the material through the forming tools, and by its inherent other coaction with the material being processed, would be unacceptable to form a strengthened barbed tape and especially to form a barbed tape into a spiral or helical configuration.

Available equipment and processes for fabrication and formation of barbed tape, and for placing the resultant barbed tape into a spiral configuration of the type shown in U.S. Pat. No. 3,916,958 granted on Nov. 4, 1975, to S. Uhl for Process And Apparatus For Producing A Barbed Spiral is unsuitable for forming a strengthened barbed tape unless doing so by adding a rib of material or wire to the tape. The relative cost and complexity of such equipment and process and the detrimental weight, cost, and corrosion susceptibility of such barbed tapes as been reviewed above.

M. R. Mainiero in U.S. Pat. No. 4,02,952 for Apparatus And Method For Forming Barbed Tape discloses a tape which is weakened because it is formed in a polygonal shape. Barbed tape manufactured with Mainiero type equipment, and according to such processes, may also wrinkle when bent to form into a coil, especially because it cannot be produced with a reinforcing rib. Wrinkles so produced may be come areas of high stress and thus weakening the resultant barbed tape barrier.

SUMMARY OF THE INVENTION

It is therefore an object of this invention to provide a new and improved barbed tape.

It is another object of this invention to provide a new and improved barbed tape with a strengthening rib.

It is still another object of this invention to provide a new and improved method of manufacturing barbed tape.

It is yet still another object of this invention to provide a new and improved method of manufacturing barbed tape with a strengthening rib.

It is yet still another object of this invention to provide a new and improved method of manufacturing barbed tape with a strengthening rib and formed into a helical coil.

It is a further object of this invention to provide a new and improved equipment for fabricating barbed tape.

It is still a further object of this invention to provide a new and improved equipment for fabricating barbed tape with a strengthening rib and formed into a helical coil.

It is yet a further object of this invention to provide a new and improved equipment and method for forming a longitudinal groove into flat strip material.

It is yet still a further object of this invention to provide a new and improved equipment and method for bending flat material, having a longitudinal groove formed therein, into a helical coil.

This invention involves barbed tape; and contemplates fabrication and formation of barbed tape with a longitudinal strengthening groove and which is formed into a helical coil. It further comtemplates forming the strengthening groove and helical coil as part of a continuous manufacturing process that: employs a method of fabrication which utilizes a wire mandrel for groove formation; wherein the wire mandrel coacts with the so formed barbed tape while it is being formed into a helical coil wherein the flat strip material from which the barbed tape is fabricated and the wire mandrel is pushed through the formation dies.

Other objects, features, and advantages of the invention in its details of construction and arrangement of parts will be seen from the above, from the following description of the preferred embodiment when considered with the drawing and from the appended claims.

BRIEF DESCRIPTION OF THE DRAWING

In the drawing:

FIG. 2 is a plan view of a section barbed tape before roll-forming;

FIG. 3 is a plan view of a section of strengthened barbed tape after roll-forming manufactured with the equipment and according to the method of FIG. 1;

FIG. 7 is a frontal cross-sectional view of the roll-former taken on line 7—7 of FIG. 4;

FIG. 8 is a front view of the drive train for the roll-former of FIGS. 4 and 6;

BRIEF DESCRIPTION OF THE PREFERRED EMBODIMENT

Figure 1:
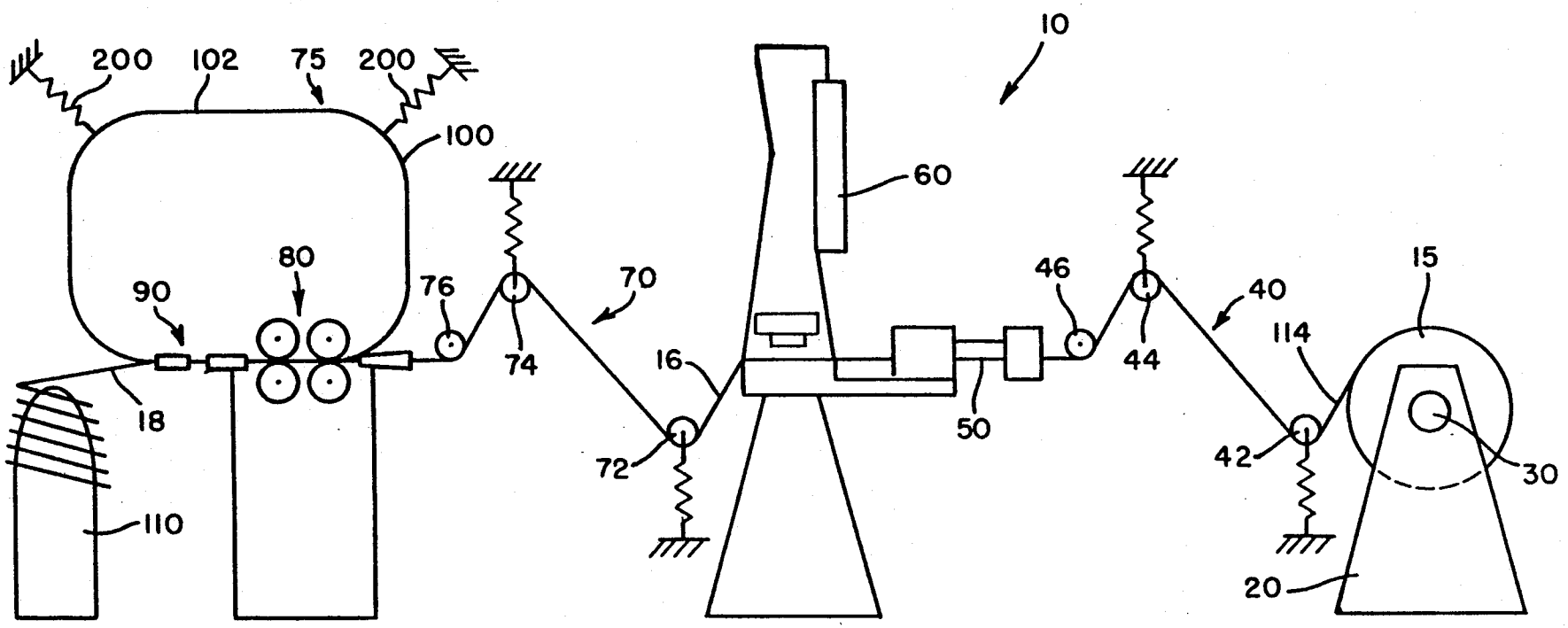
FIG. 1 is a schematic of the manufacturing process and equipment for forming strengthened barbed tape and for bending the barbed tape so formed into a helical coil, and which incorporates the instant invention.

With reference to FIG. 1, there is generally shown at 10 equipment selected, constructed and otherwise arranged to fabricate and process a strip of flat material, according to a method to be hereinafter described, so that material 14 is first stamped into a barbed configuration 16 (FIG. 2) and thereafter has a strengthening groove formed therein and the resultant strengthened barbed tape 18 is formed into a helical coil; all as will be hereinafter described. Material 14 is in the form of flat metal stock approximately one inch wide by 0.025 inches thick and is preferably provided as a "pancake" type roll 15 (FIG. 1). ASIA 430 stainless steel is one type of metal stock 14 that would be acceptable for material 14. A standard commercial stock reel support 20, with a conventional stock reel shaft 30, supports reel 15 of material 14 for subsequent un-reeling and feed through a shock absorbing loop 40. Reel support shaft 30 may, if desired, be motor driven in a conventional manner.

Material 14 is drawn through guide rollers 42, 44 and 46 of shock absorbing loop 40 by a stock feed 50 which may be a standard commercially available mechanical, pneumatic or hydraulic feed device for flat strip metal stock 14. Guide rollers 42, and 44, and 46 if desired, are disposed on suitably mounted shafts and spring loaded in conventional manner to provide shock absorbing loop 40.

Feed device 50 thereafter moves material 14 into a blanking press 60, of conventional construction, wherein barbs 62 (FIG. 2) are formed on material 14 to provide barbed strip 16. A remote loop control 70 (FIG. 1), including spring mounted idlers 72, 74, 76 of conventional construction, receives blanked barbed wire strip 16 and adjusts the feed thereof into a forming station 75. A roll-former 80, radial bender 90 and wire mandrel 100 co-operate at forming station 75 to form barbed strip 16 into a strengthened strip 18 (FIG. 3) and into a helical curved configuration for deposit upon a take-up drum 110. Roll-former 80, radial bender 90 and wire mandrel 100 are constructed and co-operate together as will be hereinafter described. Take-up drum 110 may, if desired, be powered to rotate to facilitate deposit therein of barbed strip 18.

Figure 4:
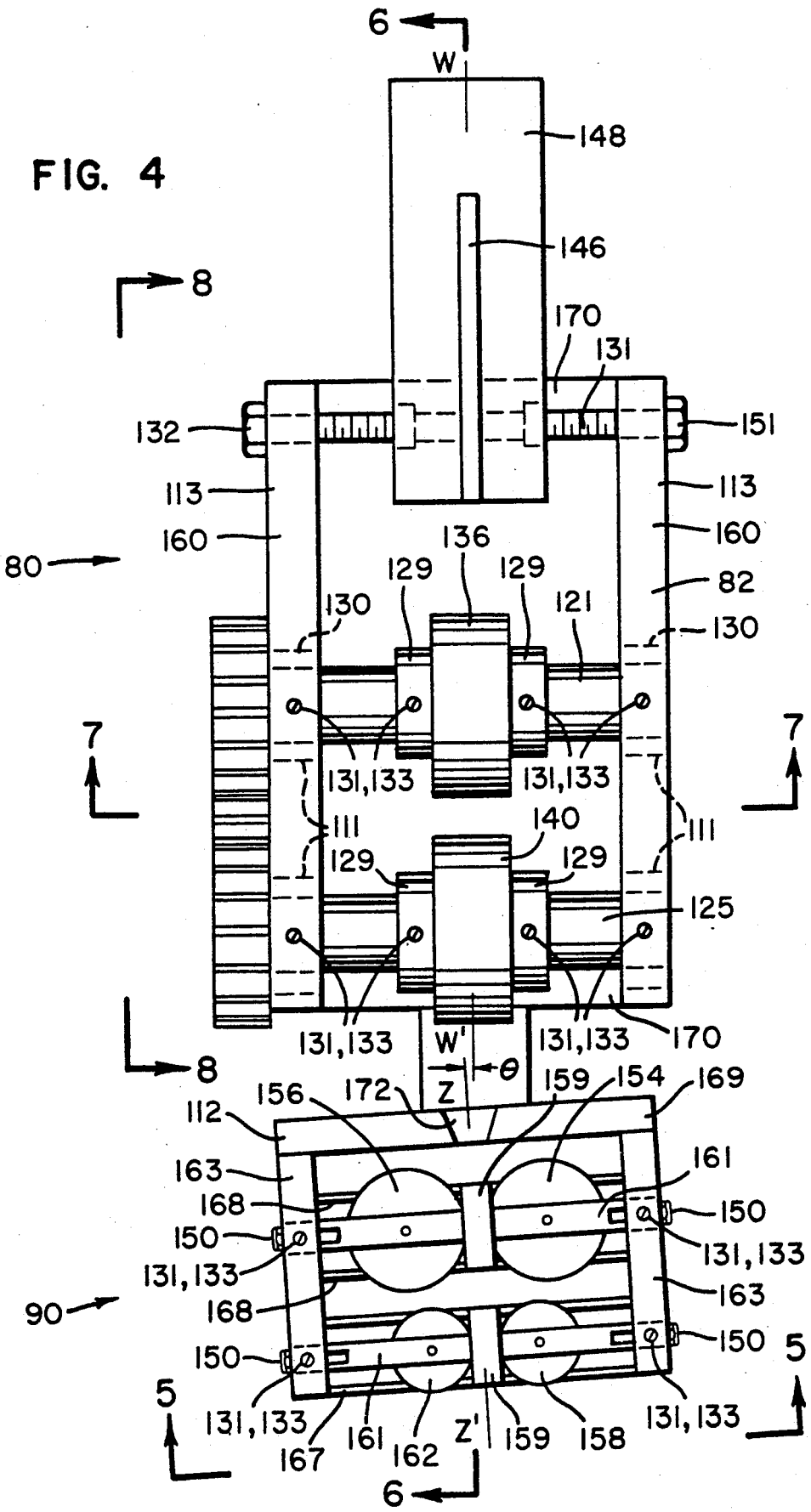
FIG. 4 is a top view of the roll-former and radial bender utilized by the equipment and which utilizes the method and process of FIG. 1.
Figure 5:
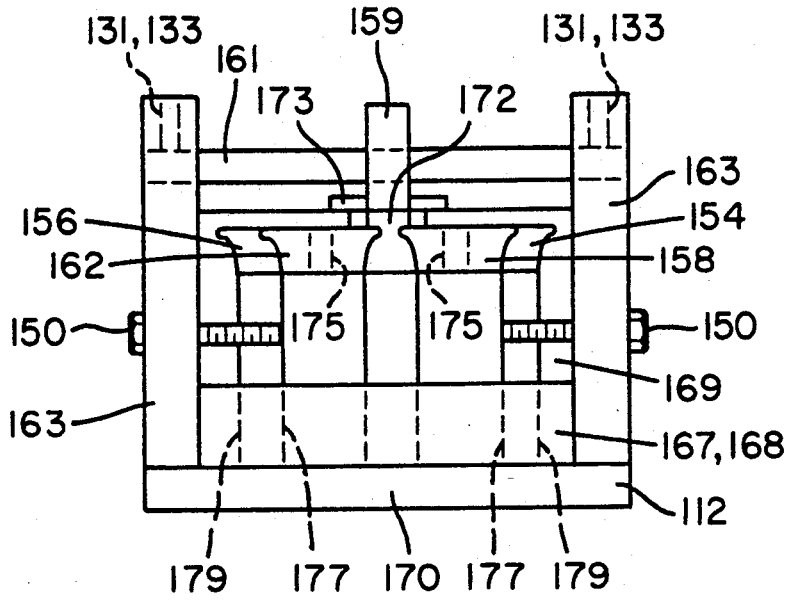
FIG. 5 is a front view of the radial bender of FIG. 4; taken along line 5—5 thereof.
Figure 6:
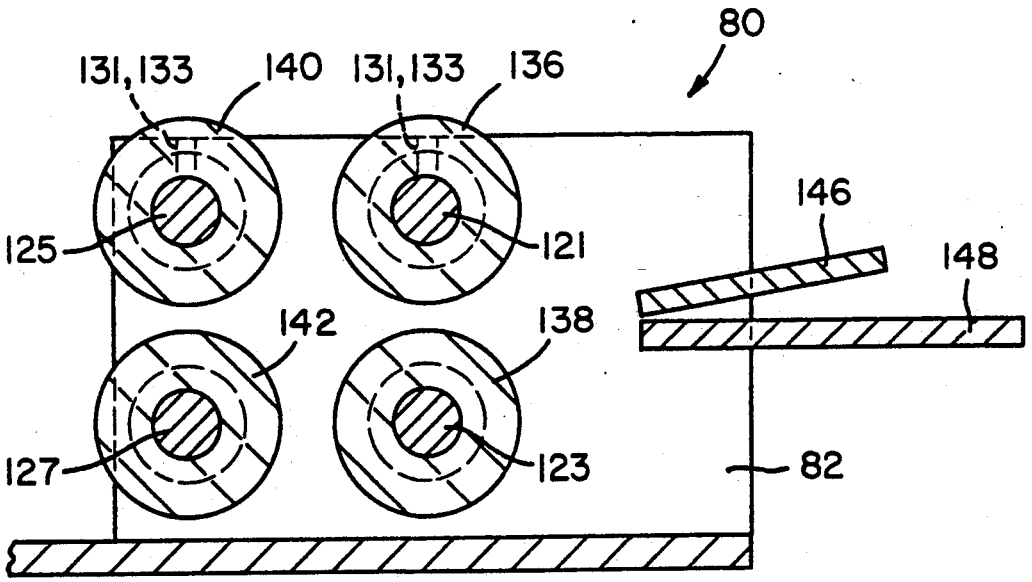
FIG. 6 is a side cross-sectional view of the roll-former taken along line 6—6 of FIG. 4.

Roller-former 80 (FIGS. 1, 4 and 6) and radial bender 90 (FIGS. 1, 4 and 5) each mounted on separate bases 82 and 112 respectively and so that radial bender base 112 and radial bender 90 may be angularly displaced with respect to roll-former 80. Rotation of radial bender 90 by movement of its base 112 (FIG. 5) sets an angle 0 formed by the offset of a centerline Z—Z (FIG. 4) through radial bender 90 from a centerline W—W through roll-former 80. Suitable and convention mechanism is provided to facilitate such movement of radial bender 90 with respect to roll-former 80 and to fix the relative positions thereof once so set-up.

A number of roll shafts 121, 123, 125 and 127 (FIGS. 4 and 6) each have their respective ends rotatively disposed in bearings 130 suitably mounted in spaced walls 113 of base 82 of roll-former 80. A collar 129 is utilized to secure a form roller 136 in position on shaft 121; while a similar collar 129 is utilized to secure a form roller 138 in position on shaft 123 so that form rollers 136, 138 may coact with each other as will be hereinafter described. Tapped holes 131 are formed in collars 129 to receive set screws 133 to facilitate securing form rollers 136, 138 in position, and to facilitate repositioning thereof. A similar set of collars 129, with tapped holes 131 and set screws 133 are utilized to position form rollers 140. 142 in position on shafts 125, 127 respectively and for coaction with each other.

A roll former gear 135 (FIGS. 7 and 8) is keyed or pinned to shaft 121, and a similar roll former gear 137 is keyed or pinned to shaft 123. Gears 135, 137 are in mesh one with the other (FIG. 8). A roll former gear 139 is keyed or pinned to shaft 127 but a similar gear is not provided for shaft 125. Roll former gears 137, 139, in turn, mesh with a drive gear 141 fixedly carried by a drive gear shaft 145 rotatively mounted in bearings 111 disposed in spaced walls of roll former 80.

A sprocket 143 suitably attached to drive gear shaft 145 receives a drive chain 144 entrained thereabout and which is also entrained about a gear 147 spaced therefrom and carried by an output shaft of a gear reducer 151. Suitable and appropriate support structure (not shown) positions gear reducer 151 for coaction with drive chain 144 and for coaction with a drive motor 144 also mounted to said support structure. Reducer 151 is of conventionally available and may, if desired, be of the Boston Gear type. It preferably provides a 10:1 gear reduction. Motor 134 is preferably a one horsepower variable speed electric motor and is suitably connected to a proper source of power and controls. The ratio of output sprocket 147 of gear reducer 151 to drive sprocket 143 is selected to be approximately 1: 2.

Figure 10:
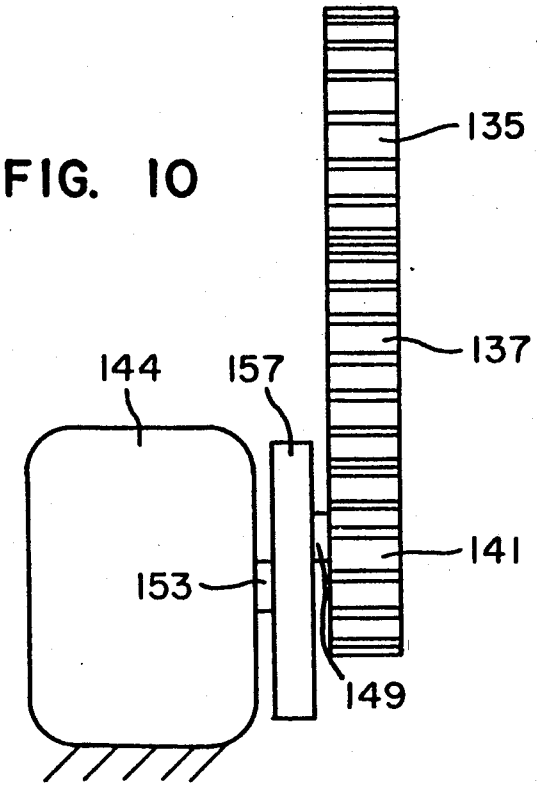
FIG. 10 is a side view of an alternate drive train for the roll-former of FIGS. 4 and 6.
Figure 9:
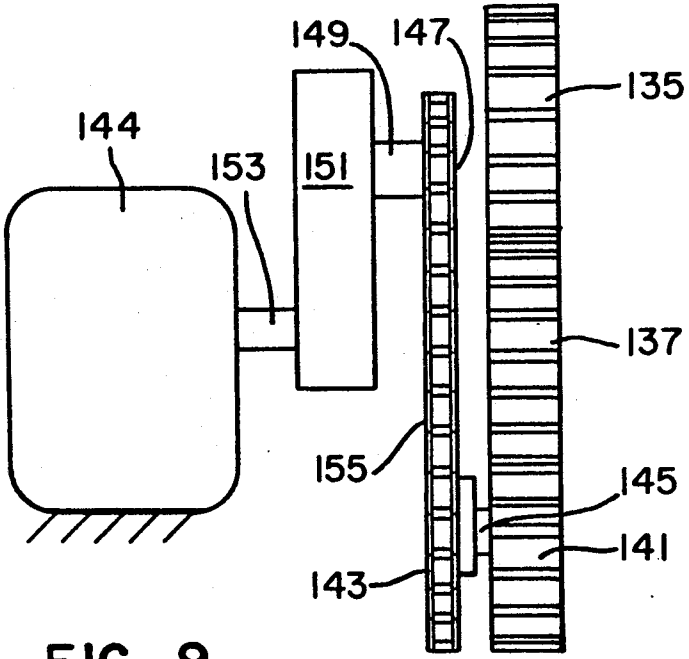
FIG. 9 is a side view of the drive train of FIG. 8.

If desired an alternative drive for roll-former 80 may be employed. Such alternative drive wouls utilize output shaft 149 (FIG. 10) of gear reducer 151 connected directly to the input shaft for drive gear 141. Gear reducer 151 would, however, preferably have a ratio of approximately 19:1.

Wire mandrel 100 includes a wire which may be solid or a rope, of predetermined thickness and length, with its ends connected together to form an endless loop. A wire guide 146 (FIGS. 4 and 6) of rubular pipe like construction, freely receives wire rope 102 so that rope 102 can pass uninhibited through guide 146. A centering guide 148 securely carries wire guide 146 and is itself mounted between the spaced side walls of form roller frame 82 on a threaded adjustment device 131. An adjustment knob 151 is fixedly secured to one end of threaded adjustment device 131; while a locknut 132 is fixedly secured to the other end thereof. When knob 151 is rotated centering guide 148 and wire guide 146 are moved either to the right or to the left (FIG. 4) resulting in a corresponding movement of wire mandrel 100 to position same for coaction with tape 14 and form rollers 136, 138, 140, 142. Once appropriately positioned locknut 132 is turned and guide 146 is locked in place.

Radial bender 90 includes a pair of primary bending rollers 154, 156 and a pair of secondary bending rollers 158, 162 all mounted between spaced side walls 163 of frame 112 of bender 90. A pair of hold-down shafts 161, also mounted between sides 163 of frame 112 of bender 90. a pair of hold-down shafts 161, also mounted between sides 163 of frame 112 each mount a hold down roller 159 for purposes to be hereinafter described. A pair of block guides 167, 168 disposed in frame 112, mount thrust bearings 175 which in turn movement bending rollers 154, 156, 158 and 162. Bearings 175 are attached to blocks 177, 179 which, in turn, fit into block guides 167, 168. Adjustment bolts 150, each mounted in threaded openings in sides 163 of frame 112 coact with blocks 177, 179 and when operated adjust the position of bending rollers 154, 156, 158 and 162.

A cover 169, attached to side walls 163 of frame 112, has formed therein a milled guide slot 172 to guide the movement of barbed tape 16 and wire rope 102 of wire mandrel 100 into radial bender 90. Spring tension guides 200 (FIGS. 1) facilitate holding wire mandrel 100 in its path of travel.

Material strip 14 (FIG. 1) is fed from reel 15 through loop control 40 to stock feed 50, which in turn feeds material strip 14 into blanking press 60 where barbs 62 (FIGS. 2) are formed thereon and strip 14 is otherwise formed into the configuration of FIG. 2. Loop guide 70 receives blanked strip 16 from press 60 and guides it into forming station 75. As strip material 16 enters roll former 80 at station 75 and through tape guide 148 it is joined by wire 102 of wire mandrel 100 through tape guide 146. Wire mandrel 100 and barbed tape 16 are fed into the nip between form rollers 136, 138 and thereafter between form rollers 140, 142. Form rollers are spaced and of a configuration to form longitudinal groove 18 (FIG. 3) into barbed strip 16.

Figure 11:
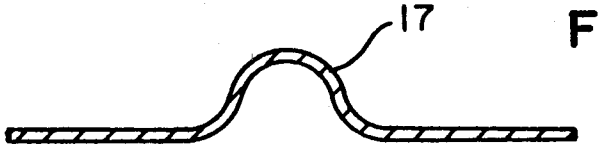
FIG. 11 is an enlarged section of a section of barbed tape manufactured by the equipment and according to the process and method of FIG. 1.

The drive from motor 144 through reducer 151, sprockets 147, 143 to drive gear 141, and gears 139, 137 and 135 driven thereby, drives shafts 127, 123 and 121 respectively to pull strip 16 and wire rope 102 through roll former 80. The pulling of strip 16 and rope 102 through former 80 forms longitudinal groove 18 in strip 16 (FIG. 11) and does so in an efficient and effective manner.

Strip 16, strenghtened by longitudinal groove 18 (FIG. 11), then proceed through coacting primary bending rollers 154, 156 (FIG. 4) of radial bender 90 and thereafter through secondary bending rollers 158, 162 thereof. While so passing between rollers 154, 156, 158, and 162 strengthened strip 18 is bent into the curved configuration of FIG. 3, formed into a helical coil, and wound onto take-up drum 110. Hold down rollers guide strip 16 through guide strip 16 through radial bender 90. Wire mandrel 100 separates from tape 18 as tape 18 moves onto take-up drum 110.

The invention as thus disclosed has wider application. The basic principle of using a continuously moving mandrel-wire which comes into contact with a metal work piece enables the plastic deformation in two axes. The first axes is the formation of the groove in the tape, the second axes is the bending of the tape with the mandrel in the work piece.

From the above description it will thus be seen that there has been provide a novel and improved strengthened barbed tape as well as equipment and a method for fabricating the strengthened barbed tape and for forming same into a helical coil.

It will be understood that although I have shown the preferred embodiments of my invention that various modifications may be made in the details thereof without departing from the spirit as comprehended by the following claims.

What is claimed is:

1. The method of forming a strengthened strip of barbed tape and bending the strengthened tape into a helical coil; comprising:

(a) providing a predetermined length of metal material in strip form having a predetermined width and a predetermined thickness permitting the material to be formed into a desired configuration;

(b) providing a forming means in position to receive said strip of material;

(c) feeding said strip of material to and through said forming means for forming an open strengthening groove longitudinally along the length of the strip in a predetermined location with respect to the width thereof;

(d) feeding a flexible wire mandrel to and through said forming means conjointly with said strip of material, said wire mandrel and said forming means co-acting with said strip of material, as it passes through said forming means, to form said strengthening groove in said strip of material;

(e) providing a radial bending means in position to receive both said strip of material and said wire mandrel as they exit said forming means;

(f) feeding said strip of material and wire mandrel to and through said radial bending means wherein said bending means bends said strip about an edge of said strip;

(g) said radial bending means co-acting with said strip of material and said wire mandrel to form said strip of material into a predetermined helical coil configuration;

(h) separating said strip of material and wire mandrel; and (i) collecting said helical coil of strip material in a collecting means.

2. The method of claim 1 including providing said wire mandrel as a continuous loop of wire rope.

3. The method of claim 2 including providing guide means to guide said wire rope into a position of co-action with said strip of material.

4. The method of claim 3 including providing blanking means for said strip of material and feeding said strip of material to said blanking means prior to feeding same to said forming means.

5. The method of claim 4 wherein said blanking means forms barbs on said strip of material.

6. The method of claim 5 including providing said strip of material in roll form and providing means to support said roll and to feed same to said blanking means.

7. The method of claim 6 including providing two sets of two forming rolls in said forming means and providing drive means to both forming rolls of one of said sets and to only one forming roll of a second one of said sets.

8. The method of claim 7 including feeding said of material and wire mandrel to and through said forming means by pushing said strip of material and wire mandrel therethrough.

9. The method of claim 8 wherein said groove is substantially semi-circular in cross-section.

10. The method of claim 9 wherein said groove extends no more than 180 degrees of arc.

11. A method for forming a strengthened helical coil of barbed tape, said method comprising:

providing a length of strip metal material of predetermined width and thickness;

moving said material to a groove forming means;

forming an open groove along a central portion of said strip material as it moves through said groove forming means wherein said groove is shaped to allow the unimpeded entry or removal of a mandrel member having an outer diameter substantially equal to an inner diameter of said groove;

moving said grooved strip material to a bending means;

locating a flexible wire mandrel member within said groove;

bending said strip material about its edge in said bending means wherein said flexible mandrel member is located within said groove throughout the bending process and acts as a mandrel within said groove substantially maintaining the groove's shape throughout the bending process;

once the grooved strip material has been bent, removing the mandrel member from the groove; and winding the formed barbed tape in a helical manner onto a collecting means.

12. The method of claim 11 further comprising forming barbs along at least one edge of said strip material prior to the material's entry into the groove forming means.

13. The method of claim 11 wherein said mandrel member moves with said strip material as said strip material passes from the forming means to the bending means.

14. The method of claim 13 wherein said wire flexible mandrel member is placed in contact with a flat face of said strip material prior to the strip material's entry into the groove forming means; and maintaining the contact between the mandrel member and the strip material during the groove forming wherein pressure is applied to said strip material to form said groove and wherein said groove partially encircles said mandrel member.

15. The method of claim 14 wherein said mandrel member travels in a circular path and once it is removed from the bent strip material, it continues along its path until it is again placed on a flat face of said strip material prior to the formation of the groove within said strip material.

* * * * *